US009822803B2

(12) United States Patent
Imura et al.

(10) Patent No.: US 9,822,803 B2
(45) Date of Patent: Nov. 21, 2017

(54) WORK MACHINE

(71) Applicants: HITACHI CONSTRUCTION MACHINERY CO., LTD., Tokyo (JP); Takako Satake, Ishioka (JP)

(72) Inventors: Shinya Imura, Toride (JP); Kouji Ishikawa, Kasumigaura (JP); Hidetoshi Satake, Ishioka (JP); Shinji Nishikawa, Kasumigaura (JP); Tomoaki Kaneta, Kasumigaura (JP); Shiho Izumi, Hitachinaka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 156 days.

(21) Appl. No.: 14/768,570

(22) PCT Filed: Aug. 28, 2014

(86) PCT No.: PCT/JP2014/072650
§ 371 (c)(1),
(2) Date: Aug. 18, 2015

(87) PCT Pub. No.: WO2015/030143
PCT Pub. Date: Mar. 5, 2015

(65) Prior Publication Data

US 2016/0003266 A1 Jan. 7, 2016

(30) Foreign Application Priority Data

Aug. 30, 2013 (JP) ..... 2013-180507

(51) Int. Cl.
*F15B 11/20* (2006.01)
*E02F 9/20* (2006.01)
(Continued)

(52) U.S. Cl.
CPC ..... *F15B 11/20* (2013.01); *E02F 9/123* (2013.01); *E02F 9/2095* (2013.01); *F15B 11/04* (2013.01);
(Continued)

(58) Field of Classification Search
CPC ..... F15B 11/20; F15B 11/04; F15B 13/0846; E02F 9/123; E02F 9/2095
(Continued)

(56) References Cited

U.S. PATENT DOCUMENTS 8,700,275 B2 * 4/2014 Edamura ..... E02F 9/123 701/29.1
8,825,316 B2 * 9/2014 Izumi ..... E02F 9/2091 701/50
(Continued)

FOREIGN PATENT DOCUMENTS

JP 2005-290882 A 10/2005
JP 2008-297754 A 12/2008
(Continued)

OTHER PUBLICATIONS

International Search Report of PCT/JP2014/072650.
(Continued)

*Primary Examiner* — Thomas E Lazo
(74) *Attorney, Agent, or Firm* — Mattingly & Malur, PC

(57) ABSTRACT

A work machine is adapted for reduced fuel consumption in regions where swinging by a hydraulic motor is prone to deterioration in efficiency, such as when the operating stroke of the swinging is small. The work machine includes an engine, a hydraulic pump, a swing structure, an electric motor for driving the swing structure, and a hydraulic motor for driving the swing structure, the hydraulic motor being driven by the hydraulic pump, and includes a swing control lever device that commands the swing structure to be driven.
(Continued)

A control device operates in either an electric swing mode in which the swing structure is driven mainly by torque of the electric motor or a hydraulic swing mode in which the swing structure is driven mainly by torque of the hydraulic motor, depending on an operating stroke of the control lever device and/or a swing speed of the swing structure.

5 Claims, 4 Drawing Sheets

(51) Int. Cl.
*E02F 9/12* (2006.01)
*F15B 11/04* (2006.01)
*F15B 13/08* (2006.01)

(52) U.S. Cl.
CPC ... *F15B 13/0846* (2013.01); *F15B 2211/6651* (2013.01); *F15B 2211/75* (2013.01); *F15B 2211/78* (2013.01)

(58) Field of Classification Search
USPC ..... 60/414
See application file for complete search history.

(56) References Cited

U.S. PATENT DOCUMENTS

2010/0162706 A1 7/2010 Sakai et al.
2013/0174556 A1* 7/2013 Nishikawa ..... E02F 9/123 60/718
2014/0165548 A1 6/2014 Satake et al.
2015/0081147 A1* 3/2015 Kawaguchi ..... B60L 3/0046 701/22

FOREIGN PATENT DOCUMENTS

JP 2011-241653 A 12/2011
JP WO 2012157510 A1 * 11/2012 ..... E02F 9/2075
WO 2012/157510 A1 11/2012

OTHER PUBLICATIONS

International Preliminary Report on Patentability received in corresponding International Application No. PCT/JP2014/072650 dated Mar. 10, 2016.
Japanese Office Action received in corresponding Japanese Application No. 2013-180507 dated Feb. 9, 2016.

* cited by examiner

WORK MACHINE

TECHNICAL FIELD

The present invention relates generally to work machines, and more particularly, to work machines including a swing structure such as a hydraulic excavator.

Background Art

Among the hybrid construction machines (work machines) using a hydraulic swing motor and an electric swing motor to drive a swing structure are those designed to ensure high operability of the swing structure and any other actuators during combined operation of these actuators, irrespective of an operating status of the electric swing motor. Patent Document 1, for example, describes such a construction machine.

PRIOR ART DOCUMENTS

Patent Documents

Patent Document 1: JP-2011-241653-A

SUMMARY OF THE INVENTION

Problems to be Solved by the Invention

According to the foregoing prior art, a total torque of the electric swing motor and the hydraulic swing motor acts to drive the swing structure. In such an electric motor, kinetic energy of the swing structure during deceleration can be regenerated via the electric swing motor. Accordingly the corresponding hybrid construction machine (work machine) can save energy, compared with a construction machine (work machine) that uses only a hydraulic swing motor to drive a swing structure.

In the prior art discussed above, the swing structure is driven by the torque constantly generated by the hydraulic swing motor, and the torque optionally added from the electric swing motor. However, when an operating stroke of swinging by an operator is small or the swing structure is swinging at a low speed, efficiency during the time from engine power output to hydraulic swing motor power output is likely to deteriorate for the following reasons, and if the deterioration actually occurs, the work machine as a whole will not be able to sufficiently reduce fuel consumption.

In the above prior art, as shown in FIG. 4 of Patent Document 1, a flow of a hydraulic fluid from a hydraulic pump is switched to the hydraulic swing motor by a swing control valve that continuously switches from a neutral position B to a position A (e.g., a right swinging position) or a position C (e.g., a left swinging position), and thereby the hydraulic fluid is supplied to the hydraulic swing motor. In addition, the swing control valve is connected to a line so that when the swing control valve is in the neutral position B, the hydraulic fluid from the hydraulic pump returns to a tank through a center bypass cutoff valve (more exactly, a bleed-off orifice).

For example, if a swing control lever is in a neutral position, the swing control valve has its spool placed in a neutral position and all the delivered hydraulic fluid from the hydraulic pump returns to the tank through the bleed-off orifice of the center bypass cutoff valve. If the swing control lever is operated for a left swing, the spool of the swing control valve switches to a position A. This lever operation reduces an opening area of the bleed-off orifice within the center bypass cutoff valve and increases opening areas of a meter-in orifice and meter-out orifice within the swing control valve, so that the delivered hydraulic fluid from the hydraulic pump is sent to an A-port of the hydraulic swing motor through the meter-in orifice at the position A. A return fluid from the hydraulic swing motor also returns to the tank through the meter-out orifice at the position A. Such flow control of the hydraulic fluid rotates the hydraulic swing motor counterclockwise. If the swing control lever is operated for a right swing, the spool of the swing control valve switches to a position C, thus causing the hydraulic swing motor to rotate clockwise after an operation sequence similar to that described above.

Incidentally, while the operating stroke of swinging ranges between its neutral and maximum levels, the spool of the swing control valve lies midway between the neutral position B and the position A or midway between the neutral position B and the position C. At this time, the hydraulic fluid that the hydraulic pump has delivered is distributed to the bleed-off orifice of the center bypass cutoff valve and the meter-in orifice of the swing control valve, and as the operating stroke of swinging becomes smaller, the bleed-off orifice of the center bypass cutoff, valve increases in opening area and the meter-in orifice and meter-out orifice of the swing control valve decrease in opening area.

As the operating stroke of swinging becomes smaller, therefore, a rate at which the hydraulic fluid delivered from the hydraulic pump flows out into the tank without passing through the hydraulic swing motor will increase, resistance to a flow of the fluid through the meter-in orifice and meter-out orifice of the swing control valve will also increase, and hence a greater deal of energy will be lost.

Even if the operating stroke of swinging is increased at a low swing speed of the swing structure, the flow rate at which the hydraulic fluid can be drawn into a port of the hydraulic swing motor will be limited. This will also pose the problem that the rate at which the hydraulic fluid delivered from the hydraulic pump flows out into the tank without passing through the hydraulic swing motor increases and hence a greater deal of energy becomes lost.

The present invention has been made on the basis of the above, and an object of the invention is to provide a work machine using a hydraulic motor and an electric motor to drive a swing structure, the work machine being adapted to reduce fuel consumption in regions where swinging by the hydraulic motor is prone to deteriorate in efficiency, such as when an operating stroke of swinging is small.

Means for Solving the Problem

A first aspect of the present invention that is contemplated to achieve the above object is a work machine including an engine, a hydraulic pump driven by the engine, a swing structure, an electric motor for driving the swing structure, a hydraulic motor for driving the swing structure, the hydraulic motor being driven by the hydraulic pump, and a swing control lever device that commands the swing structure to be driven. The work machine further includes a control device operates in either an electric swing mode in which the swing structure is driven mainly by torque of the electric motor or a hydraulic swing mode in which the swing structure is driven mainly by torque of the hydraulic motor, depending on an operating stroke of the control lever device and/or a swing speed of the swing structure.

Effect of the Invention

The work machine of the present invention that uses the hydraulic motor and the electric motor to drive the swing structure is adapted to reduce the fuel consumption in the regions where swinging by the hydraulic motor is prone to deteriorate in efficiency, such as when the operating stroke of swinging is small.

MODES FOR CARRYING OUT THE INVENTION

Hereunder, embodiments of the present invention will be described per the accompanying drawings, with a hydraulic excavator taken as an example of a work machine. The present invention can be applied to substantially a full range of work machines including a swing structure, and the application of the invention is not limited to hydraulic excavators. For example, the present invention can also be applied to other construction machines such as a crane car including a swing structure.

First Embodiment

Figure 1:
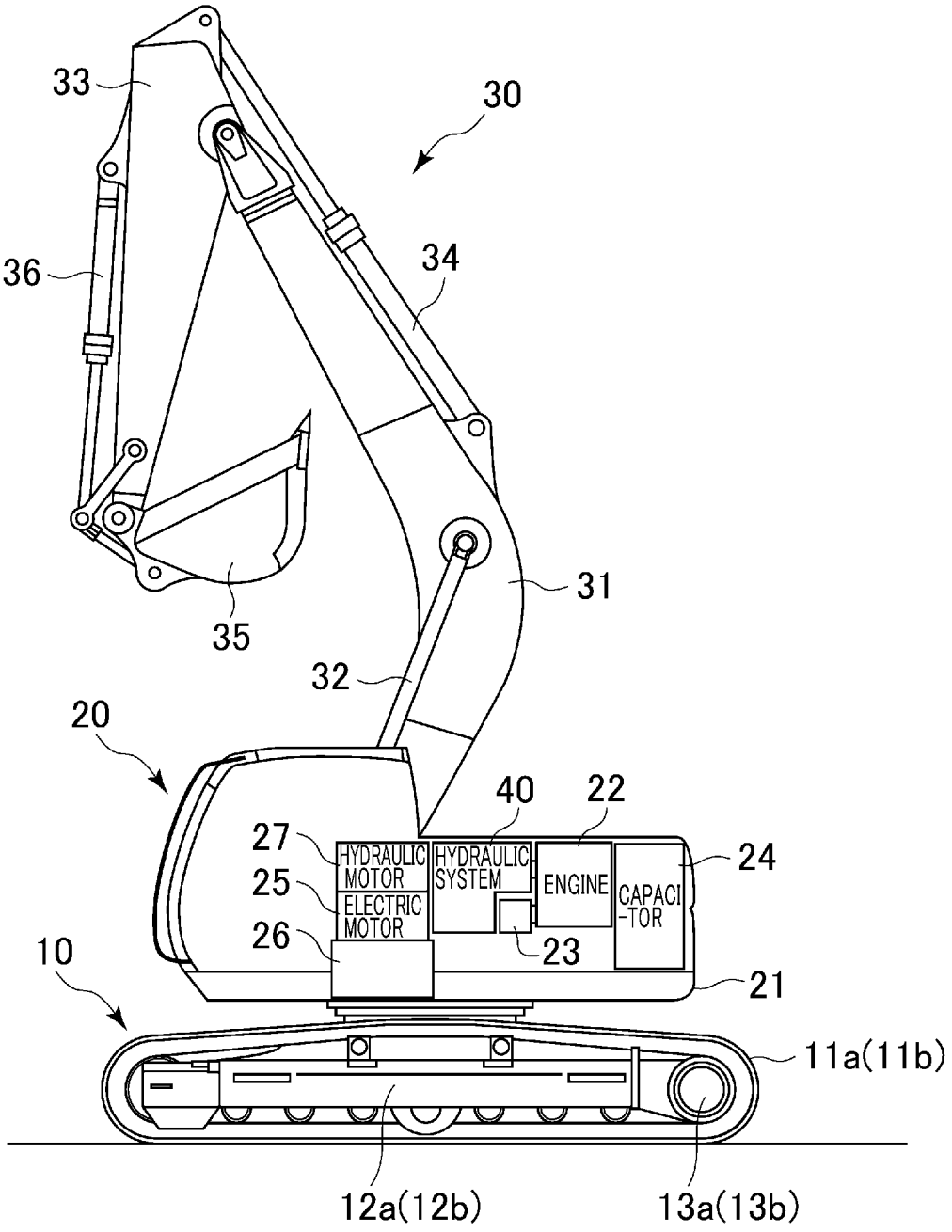
FIG. 1 is a side view of a work machine according to a first embodiment of the present invention.
Figure 2:
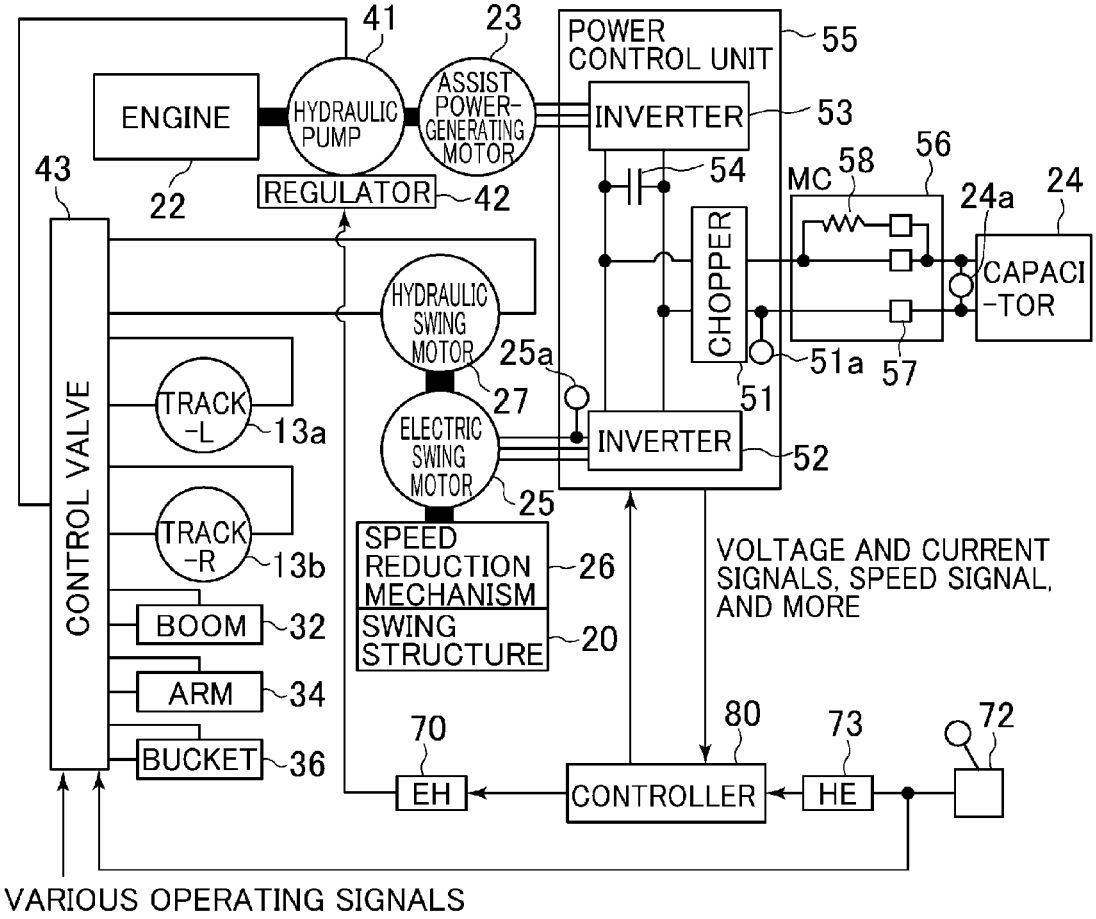
FIG. 2 is a system configuration diagram of electric and hydraulic devices which are constituent elements of the work machine according to the first embodiment of the present invention.
Figure 3:
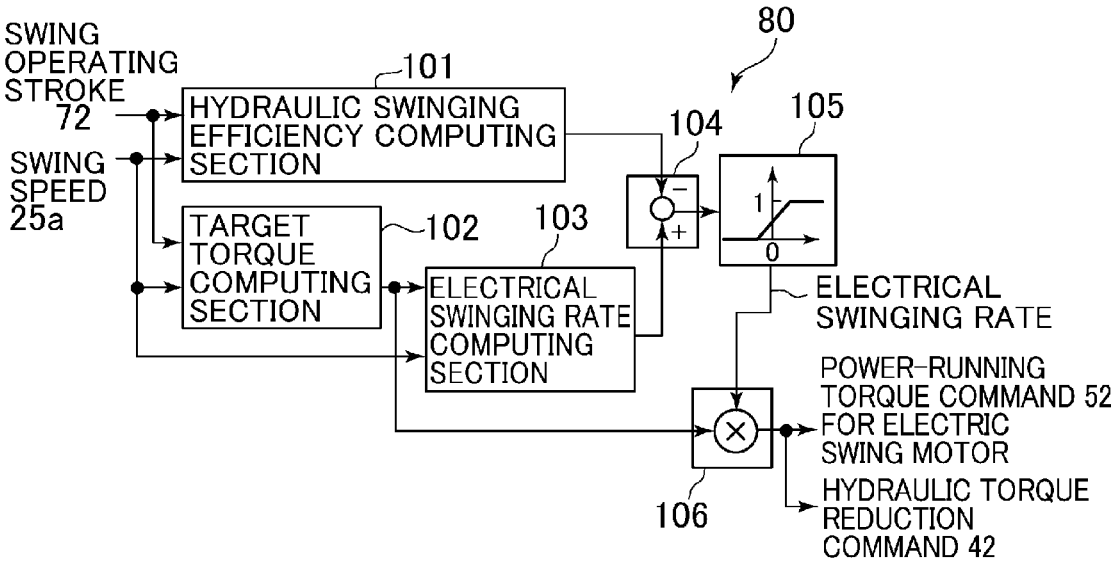
FIG. 3 is a control block diagram of a controller which is a further constituent element of the work machine according to the first embodiment of the present invention.

FIG. 1 is a side view of a work machine according to a first embodiment of the present invention, FIG. 2 is a system configuration diagram of electric and hydraulic devices which are constituent elements of the work machine according to the first embodiment of the present invention, and FIG. 3 is a control block diagram of a controller which is a further constituent element of the work machine according to the first embodiment of the present invention.

Referring to FIG. 1, a hydraulic excavator that is the work machine according to the present embodiment includes a track structure 10, a swing structure 20 swingably disposed on the track structure 10, and an excavator mechanism (front work implement) 30 mounted on the swing structure 20.

The track structure 10 includes one pair of crawlers, 11*a* and lib, one pair of crawler frames, 12*a* and 12*b* (in FIG. 1, only one of the crawler frames is shown), one pair of hydraulic track motors, 13*a* and 13*b* that drivingly control the crawlers 11*a* and 11*b* independently, and a speed reduction mechanism for the hydraulic track motors 13*a* and 13*b*.

The swing structure 20 includes a swing frame 21, an engine 22 disposed as a prime mover above the swing frame 21, an assist power-generating motor 23 driven by the engine, an electric swing motor 25, a hydraulic swing motor 27, an electric double-layer capacitor 24 connected to the assist power-generating motor 23 and the electric swing motor 25, and a speed reduction mechanism 26 that decelerates rotations of the electric swing motor 25 and the hydraulic swing motor 27.

A driving force of the electric swing motor 25 and the hydraulic swing motor 27 is transmitted to the swing structure 20 (and the swing frame 21) via the speed reduction mechanism 26, and the driving force drives the swing structure 20 (and the swing frame 21) to swing with respect to the track structure 10.

In addition, the excavator mechanism 30 is mounted on the swing structure 20. The excavator mechanism 30 includes following elements: a boom 31, a boom cylinder 32 for driving the boom 31, an arm 33 axially supported near a distal end of the boom 31 so as to be rotatable, an arm cylinder 34 for driving the arm 33, a bucket 35 axially supported at a distal end of the arm 33 so as to be rotatable, and a bucket cylinder 36 for driving the bucket 35.

Furthermore, a hydraulic system 40 for driving hydraulic actuators such as the hydraulic track motors 13*a* and 13*b*, hydraulic swing motor 27, boom cylinder 32, arm cylinder 34, and bucket cylinder 36, is mounted on the swing frame 21 of the swing structure 20. The hydraulic system 40 includes a variable displacement type of hydraulic pump 41 (see FIG. 2), a regulator 42 (also, see FIG. 2) that changes a capacity of the hydraulic pump 41 by changing a tilt angle thereof, and a control valve 43 (likewise, see FIG. 2) for drivingly controlling the actuators. The hydraulic pump 41 is driven by the engine 22 and delivers a hydraulic fluid in proportion to a product of the number of rotations and the capacity.

The following outlines a system configuration of the hydraulic excavator's electric and hydraulic devices. As shown in FIG. 2, in accordance with a swinging command (hydraulic pilot signal) from a swing control lever device 72, the control valve 43 actuates a spool for swinging and controls a flow rate and direction of the hydraulic fluid supplied to the hydraulic swing motor 27. Additionally, in accordance with operating commands (hydraulic pilot signals) from other control lever devices, the control valve 43 actuates various spools and controls a flow rate and direction of the hydraulic fluid supplied to the boom cylinder 32, the arm cylinder 34, the bucket cylinder 36, and the hydraulic track motors 13 and 13*b*.

In addition to the above-mentioned assist power-generating motor 23, capacitor 24, and electric swing motor 25, the electric driving system includes a power control unit 55, a main contactor 56, and other elements. The power control unit 55 includes a chopper 51, inverters 52 and 53, a smoothing capacitor 54, and related elements, and the main contactor 56 includes a main relay 57, a surge current limiter 58, and related elements. The power control unit 55 is also provided with a speed sensor 25*a* for detecting a rotational speed of the electric swing motor 25, a voltage sensor 24*a* for detecting a voltage of the capacitor 24, and a current sensor 51*a* for detecting a current of the chopper 51, and the power control unit 55 outputs a detection signal from each of these sensors to the controller 80.

Direct-current power from the capacitor 24 is stepped up to a predetermined busbar voltage by the chopper 51, and then input to an inverter 52 for driving the electric swing motor 25, and an inverter 53 for driving the assist power-generating motor 23. The smoothing capacitor 54 is disposed to stabilize the busbar voltage. The electric swing motor 25 and the hydraulic swing motor 27 have respective rotating shafts coupled to each other to drive the swing structure 20 via the speed reduction mechanism 26. The capacitor 24 is charged or discharged, depending on driving states (power-running or regeneration states) of the assist power-generating motor 23 and the electric swing motor 25.

The controller 80 includes: an input block that receives such input signals as the swinging command signal from the swing control lever device 72, the speed signal from the electric swing motor 25, the voltage signal from the capacitor 24, the current signal from the chopper 51; an arithmetic block using these input signals to compute such values as a torque command value for the electric swing motor 25, torque command value for the assist power-generating motor 23, and output reduction signal for the hydraulic pump 41; and an output block that outputs the command values that the arithmetic block has computed.

A swing operating stroke signal that has been obtained by converting the output signal of the swing control lever device 72 into an electrical signal by a hydraulic-to-electrical signal conversion device (e.g., a pressure sensor) 73 is input to the input block of the controller 80. Also input to the input block are the electric swing motor speed signal detected by the speed sensor 25*a*, the voltage signal of the capacitor 24 detected by the voltage sensor 24*a*, and the chopper current signal detected by the current sensor 51*a*.

The torque command addressed to the electric swing motor 25, and the torque command addressed to the assist power-generating motor 23 are output from the output block of the controller 80 to the power control unit 55, by which the inverters 52 and 53 corresponding to the output torque commands are then controlled. The output reduction command addressed to the hydraulic pump 41 is also output from the output block of the controller 80 through an electrical-to-hydraulic signal conversion device 70 to the regulator 42, by which the output (capacity) of the hydraulic pump 41 is then controlled. The electrical-to-hydraulic signal conversion device 70, which receives an electrical signal from the controller 80 and converts the electrical signal into a hydraulic pilot signal, is equivalent to a solenoid-actuated proportional valve, for example.

When the swing control lever device 72 is operated by an operator, a hydraulic pilot signal corresponding to the operating direction and the operating stroke is developed and input to the control valve 43. In addition, the swing operating stroke signal is converted into an electrical signal and input to the controller 80 via the hydraulic-to-electrical signal conversion device 73. Thus the control valve for the hydraulic swing motor 27 is opened and the hydraulic swing motor 27 is driven, which in turn drives the electric swing motor 25 electrically powered from the capacitor 24.

During this sequence in the first embodiment of the present invention, the torque command to the electric swing motor 25, the output reduction command to the hydraulic pump 41, and other signals are computed on the basis of the swing operating stroke and the swing motor speed, and then output to reduce fuel efficiency of the work machine.

Next, the control by the controller 80 will be described below with reference to FIG. 3. As shown in FIG. 3, the arithmetic block of the controller 80 includes a hydraulic swinging efficiency computing section 101, a target torque computing section 102, an electrical swinging efficiency computing section 103, a subtracting section 104, an electrical swinging rate computing section 105, and a multiplying section 106.

The hydraulic swinging efficiency computing section 101 receives the swing operating stroke signal and the speed signal of the electric swing motor 25, and then uses the two signals to compute conversion efficiency between output of the engine and output of the hydraulic swing motor 27 (the efficiency will be hereinafter referred to as hydraulic swinging efficiency). More specifically, the hydraulic swinging efficiency computing section 101 views, for example, a table based on the swing operating stroke and the electric swing motor speed, thereby calculating hydraulic swinging efficiency. This table is set on the basis of prior measurement results relating to a relationship between the swing operating stroke signal, the electric swing motor speed signal, and hydraulic swinging efficiency. A signal value denoting the hydraulic swinging efficiency that the hydraulic swinging efficiency computing section 101 has calculated is input to one side of the subtracting section 104.

The target torque computing section 102 receives the swing operating stroke signal and the speed signal of the electric swing motor 25, and then uses the two signals to compute a target total torque value (hereinafter, referred to simply as the target torque) of the hydraulic swing motor 27 and the electric swing motor 25. More specifically, the target torque efficiency computing section 102 views, for example, a table based on the swing operating stroke and the electric swing motor speed, thereby calculating the target torque. This table is set on the basis of prior measurement results relating to a relationship between a swing operating stroke, swing speed signal, and hydraulic swing motor torque of a conventional hydraulic excavator not equipped with an electric swing motor. A signal value denoting the target torque that the target torque computing section 102 has calculated is input to one side of the electrical swinging efficiency computing section 103 and one side of the multiplying section 106.

The electrical swinging efficiency computing section 103 receives the input signal value of the target torque calculated by the target torque computing section 102, and the speed signal of the electric swing motor 25, and then uses the two signals to compute conversion efficiency between output of the engine and output of the electric swing motor, in a case where the electric swing motor 25 generates all the target torque (hereinafter, the efficiency will be referred to as electrical swinging efficiency). The efficiency is that at which the electric power that the assist power-generating motor 23 has generated using engine output power is stored into the capacitor 24 and this stored power is used to drive the electric swing motor 25. More specifically, the electrical swinging efficiency computing section 103 views, for example, a table based on the electric swing motor torque and the swing motor speed, thereby calculating electrical swinging efficiency. This table is set on the basis of prior measurement results relating to a relationship between the electric swing motor torque, the swing motor speed, and electrical swinging efficiency. A signal value denoting the electrical swinging efficiency that the electrical swinging efficiency computing section 103 has calculated is input to the other side of the subtracting section 104.

The subtracting section 104 subtracts, from the input signal value of the electrical swinging efficiency calculated by the electrical swinging efficiency computing section 103, the input signal value of the hydraulic swinging efficiency calculated by the hydraulic swinging efficiency computing section 101, and then inputs the thus-calculated differential signal to the electrical swinging rate computing section 105.

The electrical swinging rate computing section 105 computes an electrical swinging rate according to the difference between electrical swinging efficiency and hydraulic swinging efficiency, calculated by the subtracting section 104. More specifically, the subtracting section 104 views, for example, a table based on the difference between electrical swinging efficiency and hydraulic swinging efficiency, and calculates the electrical swinging rate. In this table, a characteristics curve indicating that as shown in FIG. 3, the electrical swinging rate will be higher as electrical swinging efficiency becomes higher than hydraulic swinging efficiency is set in advance. The signal value of the electrical swinging rate which the electrical swinging rate computing section 105 has calculated is input to the other side of the multiplying section 106.

The multiplying section 106 multiplies the input signal value of the target torque calculated by the target torque computing section 102, by the input signal value of the electrical swinging rate computed by the electrical swinging rate computing section 105, and then outputs the calculated value to the power control unit 55 as the torque command value for the electric swing motor 25.

In addition, at this time, the same value as the torque command value for the electric swing motor 25 is output, in the form of a hydraulic swing motor torque reduction command as a hydraulic pump output reduction command value, to the regulator 42 via the electrical-to-hydraulic signal conversion device 70, thereby to control the output (capacity) of the hydraulic pump 41.

More specifically, the output of the hydraulic pump is controlled in the following steps, for example:

(1) A pressure reduction command value for the hydraulic swing motor is calculated from the torque reduction command value for the hydraulic swing motor (the hydraulic motor torque is calculated from an expression of [hydraulic motor torque=hydraulic motor pressure×hydraulic motor capacity/2Π], where the capacity of the hydraulic swing motor is a fixed value);

(2) The pressure reduction command value for the hydraulic swing motor, calculated in above step (1), is multiplied by a predetermined gain value of at least 1,whereby a target pump output to be reduced is then calculated; and (3) The hydraulic pump 41 has its flow rate controlled to decrease so that a pressure at which the hydraulic pump 41 delivers the fluid will decrease by the value calculated in above step (2) as the target pump output to be reduced.

Alternatively the following control steps may be used:

(A) The output reduction command value for the hydraulic swing motor is calculated from the torque reduction command value for the hydraulic swing motor (the hydraulic motor output is calculated from an expression of [hydraulic motor output=hydraulic motor torque×hydraulic motor angular velocity]);

(B) The output reduction command value for the hydraulic swing motor, calculated in above step (A), is multiplied by the predetermined gain value of at least 1, whereby the target pump output to be reduced is then calculated; and (C) The output of the hydraulic pump 41 is controlled to decrease by the value calculated in above step (B).

The use of either of the above two sets of control steps allows the calculation of electrical swinging efficiency and hydraulic swinging efficiency, whereby the swing structure can be driven at either swinging efficiency, whichever is the higher, can be achieved and hence the fuel consumed during swinging in regions of low hydraulic swinging efficiency can be reduced.

In the above-described first embodiment of the present invention relating to a work machine, the work machine using the hydraulic swing motor 27 and the electric swing motor 25 to drive the swing structure 20 can reduce the fuel consumption in the regions where swinging by the hydraulic swing motor 27 is prone to deteriorate in efficiency, such as when the operating stroke of swinging is small.

As described above, when the operating stroke of swinging is small, hydraulic swinging efficiency is prone to deteriorate, so that the electrical swinging rate is set to be a trifle high. In addition, when the operating stroke of swinging is small, since conventional hydraulic excavators without an electric swing motor are generally small in hydraulic swing motor torque, the torque to be controlled in the present embodiment is set to be a trifle small. When the operating stroke of swinging is small, therefore, the swing structure is swung primarily by the electric swing motor, and the torque of this motor can be small. Accordingly, the electric motor to be mounted can also be low in torque performance, that is, small in maximum torque. To be more specific, the electric motor can have its maximum output reduced below that of the hydraulic motor.

Since the torque performance of the electric motor can be reduced, output performance of the electrical system including the inverters can also be reduced. The reduction in the output performance of the electrical system including the inverters as well as the electric motor to be mounted leads to a dimensional reduction and hence to an improvement in mountability. These factors, in turn, reduce production costs.

Second Embodiment

Figure 4:
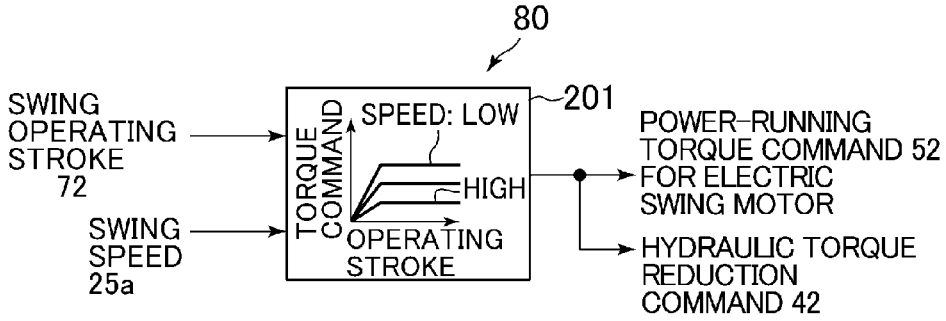
FIG. 4 is a control block diagram of a controller which is a constituent element of a work machine according to a second embodiment of the present invention.

Hereunder, a work machine according to a second embodiment of the present invention will be described per a part of the accompanying drawings. FIG. 4 is a control block diagram of a controller which is a constituent element of the work machine according to the second embodiment of the present invention. Referring to FIG. 4, the same reference numbers as used in FIGS. 1 to 3 denote the same elements, and detailed description of these elements is therefore omitted below.

The electric and hydraulic devices in the work machine according to the second embodiment of the present invention are substantially of the same system configuration as in the first embodiment. Processing that is executed in an arithmetic block of the controller 80, however, differs from processing in the first embodiment.

The arithmetic block of the controller 80 in FIG. 4 includes an electric swing motor torque computing section 201. The electric swing motor torque computing section 201 receives a swing operating stroke signal and an electric swing motor speed signal, and then uses the two signals to compute a target torque value of the electric swing motor 25. More specifically, the electric swing motor torque computing section 201 views, for example, a table based on the swing operating stroke and the electric swing motor speed, thereby calculating the target torque value of the electric swing motor. This table is set on the basis of the prior measurement results relating to the relationship between the swing operating stroke, swing speed signal, and hydraulic swing motor torque of the conventional hydraulic excavator configured so that the swing structure is swung only by a hydraulic motor.

In the present embodiment, as shown in FIG. 4, a plurality of characteristics curves corresponding to swing speed levels are set in advance as the table, with the operating stroke plotted on a horizontal axis and the torque command on a vertical axis.

The electric swing motor torque computing section 201 outputs the calculated value as the torque command value of the electric swing motor 25 to the power control unit 55. In addition, at this time, the same value as the torque command value of the electric swing motor 25 is output, in the form of a hydraulic pump output reduction command as a hydraulic swing motor torque reduction command value, to the regulator 42 via the electrical-to-hydraulic signal conversion device 70, thereby to control the output (capacity) of the hydraulic pump 41.

If the electric swing motor torque command value to be set in the electric swing motor torque computing section 201 is set to be near 0 in a region of large swing operating strokes or a region of high swing speeds or set to be a small value relative to the torque of the hydraulic swing motor 27, the swing structure can be swung in that region primarily by the hydraulic swing motor 27 (this swinging form will be hereinafter referred to as the hydraulic swing mode).

The work machine according to the second embodiment of the present invention provides substantially the same advantageous effect as that of the first embodiment.

Additionally in the work machine according to the second embodiment of the present invention, when the operating stroke of swinging is small or the swing motor speed is low, the swing structure can be driven in an electric swing mode, and under other conditions, the swing structure can be driven in the hydraulic swing mode. Consequently, the fuel consumption in the regions where hydraulic swinging efficiency is prone to deteriorate can be reduced.

Third Embodiment

Figure 5:
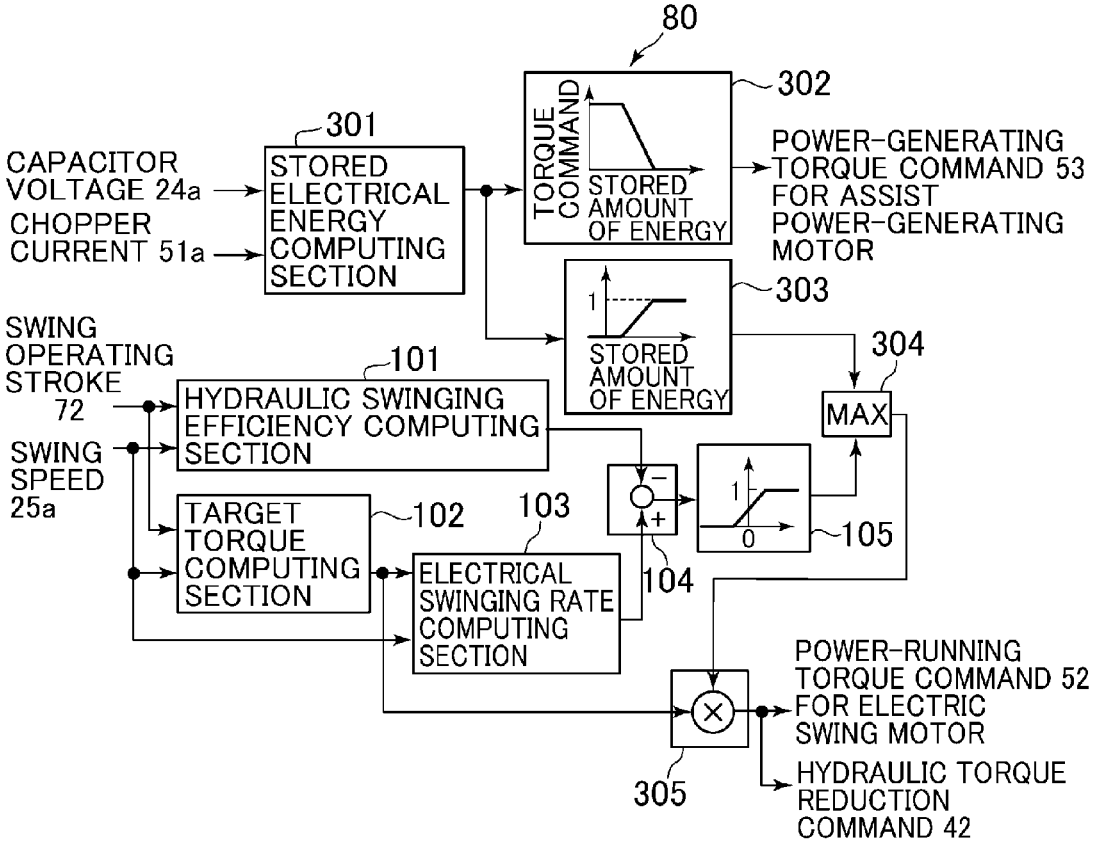
FIG. 5 is a control block diagram of a controller which is a constituent element of a work machine according to a third embodiment of the present invention.

Hereunder, a work machine according to a third embodiment of the present invention will be described per a part of the accompanying drawings. FIG. 5 is a control block diagram of a controller which is a constituent element of the work machine according to the third embodiment of the present invention. Referring to FIG. 5, the same reference numbers as used in FIGS. 1 to 4 denote the same elements, and detailed description of these elements is therefore omitted below.

The electric and hydraulic devices in the work machine according to the third embodiment of the present invention are substantially of the same system configuration as in the first embodiment. Processing that is executed in an arithmetic block of the controller 80, however, differs from processing in the first embodiment.

The arithmetic block of the controller 80 in FIG. 5 includes a hydraulic swinging efficiency computing section 101, a target torque computing section 102, an electrical an electrical swinging efficiency computing section 103, a subtracting section 104, an electrical swinging rate computing section 105, a stored electrical energy computing section 301, an assist power-generating motor torque command computing section 302, an electrical swinging rate computing section 303, a maximum value selective computing section 304, and a multiplying section 305. Here, the hydraulic swinging efficiency computing section 101 to the electrical swinging rate computing section 105 are substantially the same as those of the first embodiment, and detailed description of these elements is therefore omitted below.

The stored electrical energy computing section 301 calculates the amount of electrical energy E stored within a capacitor 24, from a capacitor voltage signal V that a voltage sensor 24*a* has detected, and a chopper current signal I that a current sensor 51*a* has detected (a direction in which current flows into the capacitor 24 is defined as plus). More specifically, the stored electrical energy computing section 301 calculates E using the following expression:

$$E=\frac{1}{2}\times C\times(V-I\times R)^2$$

where C denotes a capacity of the capacitor and R denotes internal resistance of the capacitor. A signal value denoting the stored amount of electrical energy that the stored electrical energy computing section 301 has calculated is input to the assist power-generating motor torque command computing section 302 and the electrical swinging rate computing section 303.

The assist power-generating motor torque command computing section 302 computes an assist power-generating motor torque command value from the stored amount of electrical energy calculated by the stored electrical energy computing section 301. More specifically, the assist power-generating motor torque command computing section 302 views, for example, a table based on the stored amount of electrical energy, and calculates the assist power-generating motor torque command value. As shown in FIG. 5, a characteristics curve assuming that when the stored amount of electrical energy decreases below a certain level, the torque command value of the assist power-generating motor will be increased for electrical generation, is set in advance in the table. The calculated torque command value of the assist power-generating motor is output to a power control unit 55.

The electrical swinging rate computing section 303 computes the electrical swinging rate from the stored amount of electrical energy calculated by the stored electrical energy computing section 301. More specifically, the electrical swinging rate computing section 303 views, for example, the table based on the stored amount of electrical energy, and calculates the electrical swinging rate. As shown in FIG. 5, a characteristics curve assuming that the electrical swinging rate increases with increases in the stored amount of electrical energy increases is set in advance in the table. The electrical swinging rate that the electrical swinging rate computing section 303 has calculated is input to one side of the maximum value selective computing section 304.

The maximum value selective computing section 304 receives at the other input side an input signal value of the electrical swinging rate calculated by the electrical swinging rate computing section 105, and selectively outputs the input value of the electrical swinging rate calculated by the electrical swinging rate computing section 303, or the input value of the electrical swinging rate calculated by the electrical swinging rate computing section 105, whichever is the greater. A signal value denoting the electrical swinging rate selected by the maximum value selective computing section 304 is input to one side of the multiplying section 305.

The multiplying section 305 first receives at the other input side an input signal value of a target torque calculated by the target torque computing section 102. Next, the multiplying section 305 multiplies the target torque signal by the signal value of the electrical swinging rate selected by the maximum value selective computing section 304, and outputs the calculated value as the torque command value of the electric swing motor 25 to the power control unit 55.

In addition, at this time, the same value as the torque command value of the electric swing motor 25 is output as a hydraulic swing motor torque reduction command value to a regulator 42 via an electrical-to-hydraulic signal conversion device 70, thereby to control an output (capacity) of a hydraulic pump 41.

The work machine according to the third embodiment of the present invention provides substantially the same advantageous effect as that of the first embodiment.

Additionally in the work machine according to the third embodiment of the present invention, when the stored amount of electrical energy is large, the swing structure is always driven in the electrical swinging mode, which in turn improves the fuel consumption involved when the stored amount of electrical energy is large. Conversely when the stored amount of electrical energy is small, swinging efficiency in the electrical swinging mode and that of the hydraulic swinging mode are calculated and the swing structure can be driven in the more efficient mode. The fuel consumption in the regions where hydraulic swinging efficiency is prone to deteriorate, therefore, can be reduced.

Fourth Embodiment

Figure 6:
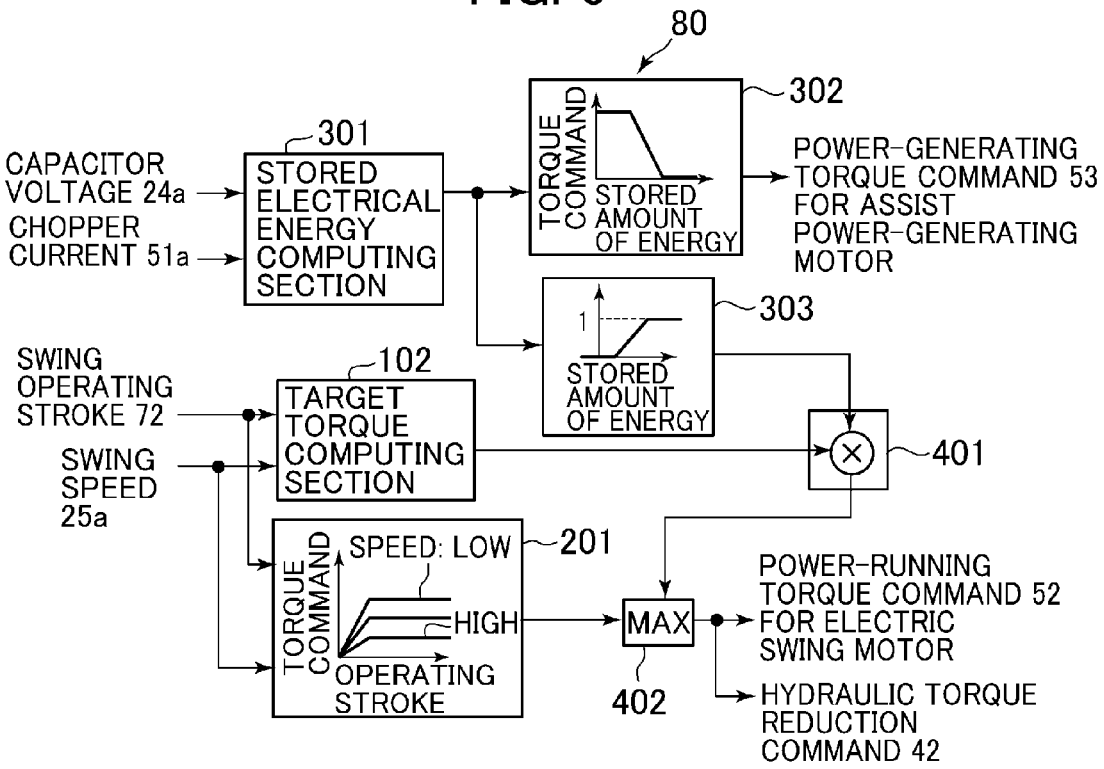
FIG. 6 is a control block diagram of a controller which is a constituent element of a work machine according to a fourth embodiment of the present invention.

Hereunder, a work machine according to a fourth embodiment of the present invention will be described per a part of the accompanying drawings. FIG. 6 is a control block diagram of a controller which is a constituent element of the work machine according to the fourth embodiment of the present invention. Referring to FIG. 6, the same reference numbers as used in FIGS. 1 to 5 denote the same elements, and detailed description of these elements is therefore omitted below.

The electric and hydraulic devices in the work machine according to the fourth embodiment of the present invention are substantially of the same system configuration as in the first embodiment. Processing that is executed in an arithmetic block of the controller 80, however, differs from processing in the first embodiment.

The arithmetic block of the controller 80 in FIG. 6 includes a target torque computing section 102, an electric swing motor torque computing section 201, a stored electrical energy computing section 301, an assist power-generating motor torque command computing section 302, an electrical swinging rate computing section 303, a multiplying section 401, and a maximum value selective computing section 402. Here, the target torque computing section 102 is substantially the same as that of the first embodiment, the electric swing motor torque computing section 201 is substantially the same as that of the second embodiment, and the stored electrical energy computing section 301 to the electrical swinging rate computing section 303 are substantially the same as those of the third embodiment. Accordingly, detailed description of the five elements, namely 201 to 303, is omitted below.

The multiplying section 401 receives at one input side a signal value denoting a target torque calculated by the target torque computing section 102, and receives at the other input side of the multiplying section 401 a signal value denoting an electrical swinging rate calculated by the electrical swinging rate computing section 303. A value obtained by multiplying these input values will be input to one side of the maximum value selective computing section 402.

The maximum value selective computing section 402 receives at the other input side a signal value denoting an electric swing motor torque command value calculated by the electric swing motor torque computing section 201, and selectively outputs a value calculated by the multiplying section 401, or the electric swing motor torque command value calculated by the electric swing motor torque computing section 201, whichever is the greater. The thus-selected value is output to a power control unit 55 as the torque command value of the electric swing motor 25.

In addition, at this time, the same value as the torque command value of the electric swing motor 25 is output as a hydraulic swing motor torque reduction command value to a regulator 42 via an electrical-to-hydraulic signal conversion device 70, thereby to control an output (capacity) of a hydraulic pump 41.

The work machine according to the fourth embodiment of the present invention provides substantially the same advantageous effect as that of the first embodiment.

Additionally in the work machine according to the fourth embodiment of the present invention, when the stored amount of electrical energy is large, the swing structure is always driven in the electrical swinging mode, which in turn improves the fuel consumption involved when the stored amount of electrical energy is large. Conversely when the stored amount of electrical energy is small, if the operating stroke of swinging is small or the swing speed is low, the swing structure can be driven in the electrical swinging mode, or under other conditions, the swing structure can be driven in the hydraulic swinging mode. The fuel consumption in the regions where hydraulic swinging efficiency is prone to deteriorate, therefore, can be reduced.

Fifth Embodiment

Figure 7:
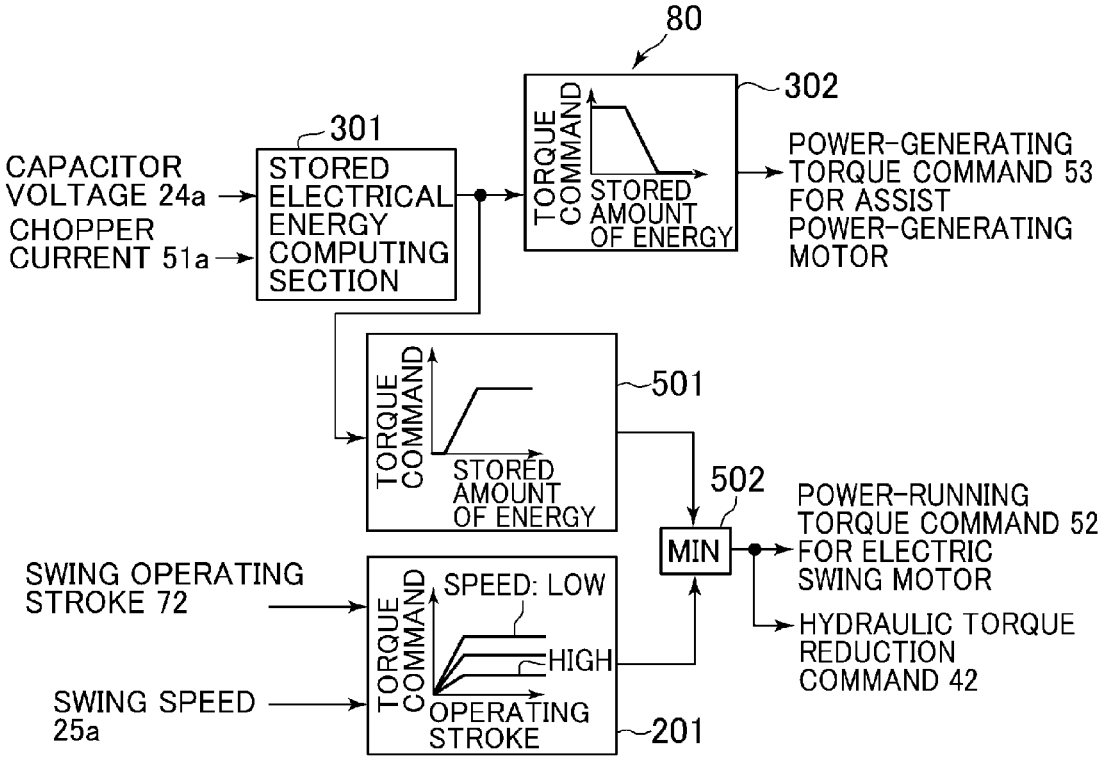
FIG. 7 is a control block diagram of a controller which is a constituent element of a work machine according to a fifth embodiment of the present invention.

Hereunder, a work machine according to a fifth embodiment of the present invention will be described per a part of the accompanying drawings. FIG. 7 is a control block diagram of a controller which is a constituent element of the work machine according to the fifth embodiment of the present invention. Referring to FIG. 7, the same reference numbers as used in FIGS. 1 to 6 denote the same elements, and detailed description of these elements is therefore omitted below.

The electric and hydraulic devices in the work machine according to the fifth embodiment of the present invention are substantially of the same system configuration as in the first embodiment. Processing that is executed in an arithmetic block of the controller 80, however, differs from processing in the first embodiment.

The arithmetic block of the controller 80 in FIG. 7 includes an electric swing motor torque computing section 201, a stored electrical energy computing section 301, an assist power-generating motor torque command computing section 302, an electric swing motor torque command computing section 501, and a minimum value selective computing section 502. Here, the electric swing motor torque computing section 201 is substantially the same as that of the second embodiment, and the stored electrical energy computing section 301 and the assist power-generating motor torque command computing section 302 are substantially the same as those of the third embodiment. Accordingly, detailed description of the three elements, namely 201, 302, and 303, is omitted below.

The electric swing motor torque command computing section 501 computes an electric swing motor torque command value from the stored amount of electrical energy calculated by the stored electrical energy computing section 301. More specifically, the electric swing motor torque command computing section 501 views, for example, a table based on the stored amount of electrical energy, and calculates the electric swing motor torque command value. As shown in FIG. 7, a characteristics curve assuming that when the stored amount of electrical energy is large, the swing structure is driven primarily by the electric swing motor, is set in advance in the table. The electric swing motor torque command value calculated by the electric swing motor torque command computing section 501 is input to one side of the minimum value selective computing section 502.

The minimum value selective computing section 502 receives at the other input side a signal value denoting an electric swing motor torque command value calculated by the electric swing motor torque computing section 201, and selectively outputs the electric swing motor torque command calculated by the electric swing motor torque command computing section 501, or the electric swing motor torque command value calculated by the electric swing motor torque computing section 201, whichever is the smaller. The thus-selected value is output to a power control unit 55 as the torque command value of the electric swing motor 25.

In addition, at this time, the same value as the torque command value of the electric swing motor 25 is output as a hydraulic swing motor torque reduction command value to a regulator 42 via an electrical-to-hydraulic signal conversion device 70, thereby to control an output (capacity) of a hydraulic pump 41.

The work machine according to the fifth embodiment of the present invention provides substantially the same advantageous effect as that of the first embodiment.

In addition, in the work machine according to the fifth embodiment of the present invention, when the stored amount of electrical energy is small, electrical swinging does not take place. This prevents occurrence of a situation under which, despite the fact that the electric swing motor torque command value has been issued, swinging cannot be executed because of the assist power-generating motor 23 failing to start generating power on time.

Furthermore, in the work machine according to the fifth embodiment of the present invention, when the stored amount of electrical energy is large and the operating stroke of swinging is small or the swing motor speed is low, the swing structure can be driven in the electric swing mode, and under other conditions, the swing structure can be driven in the hydraulic swing mode. Consequently, the fuel consumption in the regions where hydraulic swinging efficiency is prone to deteriorate can be reduced.

The configuration relating to issuing a power-generating torque command to the assist power-generating motor 23 may be omitted in any of the embodiments of the present invention. Omission of the assist power-generating motor 23 and the inverter 53 for the assist power-generating motor will improve mountability, thus lowering production costs.

DESCRIPTION OF REFERENCE NUMBERS

10: Track structure
11: Crawler
12: Crawler frame
13: Hydraulic track motor
20: Swing structure
21: Swing frame
22: Engine
23: Assist power-generating motor
24: Capacitor
24*a* Voltage sensor (device that detects the stored amount of electrical energy)
25: Electric swing motor
25*a*: Speed sensor (swing speed detection device)
26: Speed reduction mechanism
27: Hydraulic swing motor
28: Relief valve at A-port
29: Relief valve at B-port
30: Excavator mechanism
31: Boom
32: Boom cylinder
33: Arm
34: Arm cylinder
35: Bucket
36: Bucket cylinder
40: Hydraulic system
41: Hydraulic pump
42: Regulator
43: Control valve
44: Spool for swinging
51: Chopper
51*a*: Current sensor (device that detects the stored amount of electrical energy)
52: Inverter for electric swing motor
53: Inverter for assist power-generating motor
54: Smoothing capacitor
55: Power control unit
56: Main contactor
57: Main relay
58: Surge current limiter
70: Electrical-to-hydraulic signal conversion device
72: Swing control lever device
73: Hydraulic-to-electrical signal conversion device (swing control lever operating stroke detection device)
80: Controller (Control device)
101: Hydraulic swinging efficiency computing section
102: Target torque computing section
103: Electrical swinging efficiency computing section
201: Electric swing motor torque computing section
301: Stored electrical energy computing section

The invention claimed is:

1. A work machine comprising:
an engine;
a hydraulic pump driven by the engine;
a swing structure;
an electric motor for driving the swing structure;
a hydraulic motor for driving the swing structure, the hydraulic motor being driven by the hydraulic pump;
a swing control lever device that commands the swing structure to be driven;
a control device configured to operate in either an electric swing mode in which the swing structure is driven mainly by torque of the electric motor or a hydraulic swing mode in which the swing structure is driven mainly by torque of the hydraulic motor, depending on an operating stroke of the control lever device and/or a swing speed of the swing structure; and
a swing control lever operating stroke detection device that detects a swing operating stroke of the swing control lever device; and
a swing speed detection device that detects the swing speed of the swing structure,
wherein the control device acquires the swing operating stroke of the swing control lever device detected by the swing control lever operating stroke detection device and the swing speed of the swing structure detected by the swing speed detection device, and
wherein the control device operates in the electric swing mode when the swing operating stroke of the swing control lever device is less than a previously set value and/or the swing speed of the swing structure is less than a previously set value.

2. The work machine according to claim 1,
wherein the control device includes a hydraulic swinging efficiency computing section that computes conversion efficiency between output of the engine and output of the hydraulic motor, and an electrical swinging efficiency computing section that computes conversion efficiency between output of the engine and output of the electric motor, and
wherein the control device operates in either the electric swing mode or the hydraulic swing mode, depending on results of the conversion efficiency calculated by the hydraulic swinging efficiency computing section and the electrical swinging efficiency computing section.

3. The work machine according to claim 1, further comprising:

a device that stores electrical energy for driving the electric motor; and a device that detects the amount of electrical energy stored in the electrical energy storage device, wherein the control device acquires the amount of electrical energy stored in the electrical energy storage device, and wherein the control device operates in the electric swing mode in the case that the stored amount of electrical energy is larger than a previously set value.

4. The work machine according to claim 1, further comprising:

a device that stores electrical energy for driving the electric motor; and a device that detects the amount of electrical energy stored in the electrical energy storage device;

wherein the control device acquires the amount of electrical energy stored in the electrical energy storage device, and wherein the control device operates in the electric swing mode in the case that the stored amount of electrical energy is greater than a previously set value, and the swing operating stroke of the swing control lever device is less than the previously set value or the swing speed of the swing structure is lower than the previously set value.

5. The work machine according to claim 1, wherein a maximum output of the electric motor is less than a maximum output of the hydraulic motor.

* * * * *